US007357562B2

(12) United States Patent
Hawkins

(10) Patent No.: US 7,357,562 B2
(45) Date of Patent: Apr. 15, 2008

(54) COUNTER-FLOW DRUM MIXER ASPHALT PLANT WITH TWO STAGE MIXING ZONE

(76) Inventor: Michael R. Hawkins, 10735 NE. 112th St., Kansas City, MO (US) 64157

( * ) Notice: Subject to any disclaimer, the term of this patent is extended or adjusted under 35 U.S.C. 154(b) by 662 days.

(21) Appl. No.: 10/386,070

(22) Filed: Mar. 11, 2003

(65) Prior Publication Data

US 2004/0179422 A1 Sep. 16, 2004

(51) Int. Cl.
*B28C 5/46* (2006.01)

(52) U.S. Cl. ..... 366/23; 366/25

(58) Field of Classification Search ..... 366/7, 366/22–25, 33, 34, 38, 54, 56–63, 144, 145, 366/147, 167.1, 180.1, 220, 225, 228; 432/111; 34/132, 137

See application file for complete search history.

(56) References Cited

U.S. PATENT DOCUMENTS 2,421,345 A 5/1947 McConnaughay
3,999,743 A * 12/1976 Mendenhall ..... 366/4
4,075,710 A 2/1978 Jakob et al.
4,095,284 A * 6/1978 Mendenhall ..... 366/7
4,143,972 A 3/1979 Benson
4,147,436 A * 4/1979 Garbelman et al. ..... 366/25
4,153,471 A * 5/1979 Mendenhall ..... 106/281.1
4,208,131 A 6/1980 Mendenhall
4,427,376 A 1/1984 Etnyre et al.
4,481,039 A * 11/1984 Mendenhall ..... 106/281.1
4,540,287 A 9/1985 Servas et al.
4,787,938 A 11/1988 Hawkins
4,892,411 A 1/1990 Elliott et al.
4,910,540 A 3/1990 Murray
4,913,552 A 4/1990 Bracegirdle
4,919,538 A * 4/1990 Swisher, Jr. ..... 366/4
4,946,283 A 8/1990 Musil
4,948,261 A 8/1990 Marconnet
4,954,995 A 9/1990 Marconnet
4,955,722 A 9/1990 Marconnet
4,988,207 A 1/1991 Marconnet (Continued)

OTHER PUBLICATIONS

CMI News, Winter 1993.

(Continued)

*Primary Examiner*—David Sorkin
(74) *Attorney, Agent, or Firm*—Joseph B Bowman

(57) ABSTRACT

A counter-flow drum mixer asphalt plant equipped with a secondary feeder for introducing RAP to direct radiant heat of the combustion zone. Heated virgin aggregate and RAP in the combustion zone are delivered through a transition piece to a first stage of the mixing zone where liquid asphalt is combined with the materials and secondary combustion air flows through the first stage to evacuate blue smoke and steam back to the combustion zone. The second stage of the mixing zone is substantially isolated from secondary combustion air flow where dust and mineral fines are introduced and mixed to complete the asphalt product discharged from the mixing zone. Alternative constructions of the mixing zone are disclosed to provide the first and second stages having such characteristics, as well as options for both the passive and active control of the secondary combustion air. An optional secondary burner in the exhaust housing elevates the temperature of the exhaust gas above its dew point temperature before delivery to the baghouse.

17 Claims, 9 Drawing Sheets

U.S. PATENT DOCUMENTS

| | | | | |
|---|---|---|---|---|
| 4,989,986 | A | | 2/1991 | Swisher, Jr. |
| 5,002,398 | A | | 3/1991 | Musil |
| 5,052,809 | A | | 10/1991 | Young |
| 5,054,931 | A | | 10/1991 | Farnham et al. |
| 5,067,254 | A | | 11/1991 | Linkletter et al. |
| 5,073,030 | A | | 12/1991 | Banks |
| 5,085,581 | A | | 2/1992 | Mendenhall |
| 5,190,454 | A | | 3/1993 | Murray et al. |
| 5,193,935 | A | | 3/1993 | Musil |
| 5,201,839 | A | | 4/1993 | Swisher, Jr. |
| 5,294,197 | A | | 3/1994 | Prill et al. |
| 5,334,012 | A | | 8/1994 | Brock et al. |
| 5,364,182 | A | | 11/1994 | Hawkins |
| 5,470,146 | A | | 11/1995 | Hawkins |
| 5,664,881 | A | | 9/1997 | Hawkins |
| 5,664,882 | A | * | 9/1997 | Green et al. ..... 366/25 |
| 6,164,809 | A | * | 12/2000 | Hawkins ..... 366/7 |
| 6,672,751 | B2 | * | 1/2004 | Hawkins ..... 366/25 |

OTHER PUBLICATIONS

CMI Leading the Hot Mix Industry In . . . Asphalt Production Equipment, 1992.

* cited by examiner

COUNTER-FLOW DRUM MIXER ASPHALT PLANT WITH TWO STAGE MIXING ZONE

CROSS-REFERENCE TO RELATED APPLICATIONS

None

STATEMENT REGARDING FEDERALLY SPONSORED RESEARCH OR DEVELOPMENT

None

BACKGROUND OF THE INVENTION

This invention relates to a counter-flow asphalt plant used to produce a variety of asphalt compositions. More specifically, this invention relates to a counter-flow asphalt plant having a recycle asphalt (RAP) feed to the combustion zone to produce high percentage RAP asphalt products within a two stage mixing zone to improve production rates with greater economy and efficiency of plant design and operation.

Several techniques and numerous equipment arrangements for the preparation of asphaltic compositions, also referred by the trade as "hotmix" or "HMA", are known from the prior art. Particularly relevant to the present invention is the continuous production of asphalt compositions in a drum mixer asphalt plant. Typically, water-laden virgin aggregates are dried and heated within a rotating, open-ended drum mixer through radiant, convective and conductive heat transfer from a stream of hot gases produced by a burner flame. As the heated virgin aggregate flows through the drum mixer, it is combined with liquid asphalt and mineral binder to produce an asphaltic composition as the desired end-product. Optionally, prior to mixing the virgin aggregate and liquid asphalt, reclaimed or recycled asphalt pavement (RAP) may be added once it is has been crushed or ground to a suitable size. The RAP is typically mixed with the heated virgin aggregate in the drum mixer at a point prior to adding the liquid asphalt and mineral fines.

The asphalt industry has traditionally faced many environmental challenges. The drum mixer characteristically generates, as by-products, a gaseous hydrocarbon emission (known as blue smoke), various nitrogen oxides ($NO_x$) and sticky dust particles covered with asphalt. Early asphalt plants exposed the liquid asphalt or RAP material to excessive temperatures within the drum mixer or put the materials in close proximity with the burner flame which caused serious product degradation. Health and safety hazards resulted from the substantial air pollution control problems due to the blue-smoke produced when hydrocarbon constituents in the asphalt are driven off and released into the atmosphere. The exhaust gases of the asphalt plant are fed to air pollution control equipment, typically a baghouse. Within the baghouse, the blue-smoke condenses on the filter bags and the asphalt-covered dust particles stick to and plug-up the filter bags, thereby presenting a serious fire hazard and reducing filter efficiency and useful life. Significant investments and efforts were previously made by the industry in attempting to control blue-smoke emissions attributed to hydrocarbon volatile gases and particulates from both the liquid asphalt and recycle material.

The earlier environmental problems were further exacerbated by the processing technique standard in the industry which required the asphalt ingredients with the drum mixer to flow in the same direction (i.e., co-current flow) as the hot gases for heating and drying the aggregate. Thus, the asphalt component of recycle material and liquid asphalt itself came in direct contact with the hot gas stream and, in some instances, even the burner flame itself.

Many of the earlier problems experienced by asphalt plants were solved with the development of modern day counter-flow technology as disclosed in my earlier patent Hawkins U.S. Pat. No. 4,787,938 which is incorporated herein by reference and which was first commercially introduced by Standard Havens, Inc. in 1986. The asphalt industry began to standardize on the counter-flow processing technique in which the ingredients of the asphaltic composition and the hot gas stream flow through a single, rotating drum mixer in opposite directions. Combustion equipment extends into the drum mixer to generate the hot gas stream at an intermediate point within the drum mixer. Accordingly, the drum mixer includes three zones. From the end of the drum where the virgin aggregate feeds, the three zones include a drying/heating zone to dry and heat virgin aggregate, a combustion zone to generate a hot gas stream for the drying/heating zone, and a mixing zone to mix hot aggregate, recycle material and liquid asphalt to produce an asphaltic composition for discharge from the lower end of the drum mixer.

Not only did the counter-flow process with its three zones vastly improve heat transfer characteristics, more importantly it provided a process in which the liquid asphalt and recycle material were isolated from the burner flame and the hot gas stream generated by the combustion equipment. Counter-flow operation represented a solution to the vexing problem of blue-smoke and all the health and safety hazards associated with blue-smoke.

A more complete understanding of the early equipment and processing techniques used by the asphalt industry can be found in the extensive listing of prior art patents and printed publications contained in my earlier patents Hawkins U.S. Pat. No. 5,364,182 issued Nov. 15, 1994, Hawkins U.S. Pat. No. 5,470,146 issued Nov. 28, 1995, and Hawkins U.S. Pat. No. 5,664,881 issued Sep. 9, 1997. Indeed, as a result of my first patent Hawkins U.S. Pat. No. 4,787,938 becoming involved in protracted litigation, the prior art collection cited in the foregoing patents is thought to be a thorough and exhaustive bibliographic listing of asphalt technology and such prior art is specifically incorporated herein by reference.

With many of the health and safety issues associated with asphalt production solved by the advent of counter-flow technology, contemporaneous attention has now shifted to operational inefficiencies which are manifest as excessive design and production costs and poor economy of operation from excess energy consumption.

Experience has shown that the environmentally desirable use of a recycled material (RAP) in asphalt production comes with disadvantageous tradeoffs in energy consumption. The most energy efficient plant operation is achieved when no RAP is added. In such circumstances, for example, all virgin aggregate is introduced in one end of the dryer and flows as a falling curtain or veil of material in counter-current heat exchange with hot gases generated at the opposite end of the dryer. The shell temperature is characteristically about 500° F. and the exhaust gas is about 225° F. which is within the normal operating temperature for the baghouse used to filter the exhaust gas of particulate matter. The temperature of the exhaust gas stream is determined by the design of the dryer, but must be kept above its dew point to prevent moisture from condensing in the exhaust ductwork and especially in the baghouse itself. A temperature of 225° F. is sufficient, but since varying conditions during operation can cause relatively large temperature swings, most operations are controlled to keep exhaust temperatures in the range of 250° F. to 275° F.

The addition of RAP material has a significant effect on operating temperatures of the process. Conventional wisdom has taught that the RAP cannot be directly dried without burning the liquid asphalt and causing hydrocarbon smoke emissions. Accordingly, it has previously been dried indirectly by superheating the virgin aggregates and then mixing the superheated aggregates with the RAP to achieve a blended mixture temperature. This results in much higher exhaust gas temperatures and a resulting loss in fuel efficiency. Accordingly, 20 TO 40% RAP feeds (that is, operations wherein RAP makes up 20 to 40% of the final asphalt composition) have been close to the upper end of the range heretofore workable in modern counter-flow asphalt plants. Although a 50% RAP feed has been achievable, it has been at the cost of high energy and reduced equipment life. Consequently, an upper limit of approximately 40% RAP has been a realistic upper limit for the majority of asphalt plants. The operating conditions necessary are illustrative of the problems. If 50% RAP is introduced midstream in the process, then only 50% virgin aggregates are used. This means that only half the material is present, as compared to the 100% virgin aggregate production, to be heated and only half the veiling of material in the drying section of the drum occurs which yields poor heat transfer characteristics. Under such circumstances, the combustion zone temperature must be elevated significantly to superheat the virgin aggregate. This, in turn, causes the shell temperature of the drum to range from 750-800° F. and the exhaust gas temperature to increase to about 375° F. The exhaust gas temperature will now exceed the upper limit for a baghouse using polyester bags which have an upper service of about 275° F. Accordingly, more costly filter bags constructed of less heat sensitive material such as NOMEX (an aramid fiber marketed by DuPont) have to be installed in the baghouse whenever higher RAP feed operations are contemplated. Moreover, any time the combustion zone temperature rises to about 2800° F. or greater then the production of various nitrogen oxides ($NO_x$) as a product of combustion becomes a problem.

The foregoing problems associated with processing high percentage RAP are further exacerbated by the moisture content of the RAP itself. The superheat of the virgin aggregate must be sufficient to not only heat the RAP material to an appropriate mix temperature, but also supply the necessary heat to vaporize the moisture content of the RAP.

Accordingly, modern asphalt plants characteristically introduce RAP in one of two ways. Using the first method, RAP is introduced directly into an isolated mixing zone where all heat transferred to the RAP must necessarily come from superheated virgin aggregate. Using the second method, the RAP is introduced into the combustion zone but shielded from direct radiant heat by an inner shell or by special flighting to preheat the RAP by convective and conductive heat transfer before it is delivered to an isolated mixing zone.

Asphalt plants constructed like Hawkins U.S. Pat. No. 4,787,938 and other counter-flow drum mixers that followed utilized an isolated mixing zone to prevent blue smoke. For the most part they did so successfully, although not completely. However, unwanted consequences resulted from this processing technique, particularly as the use of RAP addition to asphalt compositions increased. By isolating the mixing zone from the gas stream, they create a dead zone in which any blue smoke and moisture vapor that forms within the mixing zone is not adequately evacuated. Though most of the blue smoke is eliminated by shielding the liquid asphalt exposure to the radiant heat of the flame and from exposure to the hot exhaust gas stream, smoke is generated in the mixing zone when the liquid asphalt comes in contact with the hot aggregate. This is especially true when the aggregate is superheated, as in high percentage recycle operations. Since the blue smoke is generated in a dead zone, it tends to flow with the exiting production material, and exit the drum mixer at the material discharge port. In most cases this is overlooked by the environmental agencies because it is the exhaust gas stack, and not the material discharge port, that they are charged with monitoring and enforcing pollution regulations. Still, it is likely only a matter of time until the focus of environmental protection is trained on the discharge area. Some areas of the country are already requiring blue smoke control systems for the discharge and loadout areas of an asphalt plant.

A similar problem exits with the evacuation of moisture vapor from the dead zone of an isolated mixing chamber. This is particularly true when, as in most cases, the cold, wet recycle material is introduced into the mixing zone where the moisture content is vaporized by the superheated aggregate. The resulting steam explosion from the rapidly vaporized recycle moisture causes steam and dust to be forced from the drum mixer, generally at the recycle feed collar and to some extent at the drum discharge port.

A need remains in the industry for an improved counter-flow asphalt plant design capable of utilizing high percentage RAP mixes and for operating techniques to address the problems and drawbacks heretofore experienced with modern counter-flow production. The primary objective of this invention is to meet this need.

BRIEF SUMMARY OF THE INVENTION

More specifically, an object of the invention is to provide a counter-flow asphalt plant capable of routinely using high percentage RAP mixes (e.g., up to 50% RAP) without emitting excessive blue smoke or without excessive energy requirements.

Another object of the invention is to provide a counter-flow asphalt plant capable of effectively evacuating blue smoke and steam from the mixing zone in an environmentally friendly manner even when processing high percentage RAP mixes.

Another object of the invention is to provide a counter-flow asphalt plant capable of processing up to 50% RAP mixes with extended equipment life by eliminating the need to superheat virgin aggregates with the associated temperature elevation of the processing equipment.

An alternative object of the invention is to provide a counter-flow asphalt plant capable of processing RAP mixes greater than 50% by utilizing superheating techniques together with the processing techniques which are the subject of this invention.

Another object of the invention is to provide counter-flow drum mixer equipment and method of operation for retrofitting existing asphalt plants to increase production capacity by reducing the total volume and temperature of the combustion gases present in the equipment for a given production rate.

A corollary object of the invention is to provide counter-flow drum mixer equipment and method of operation of the character previously described for retrofitting existing asphalt plants to increase production capacity by as much as 20%.

An additional object of the invention is to provide counter-flow drum mixer equipment of a reduced size for a given production rate for savings in original equipment costs, as well as savings in operating costs, by reducing the total volume and temperature of the combustion gases necessary to achieve a given production rate in a conventional counter-flow plant.

A corollary object of the invention is to provide counter-flow drum mixer equipment and method of operation of the character previously described that reduces by as much as 20% the size of the equipment required to produce a given volume of product.

A further object of the invention is to provide a counter-flow drum mixer to permit RAP material to be introduced directly into the combustion zone to take full advantage of radiant, convective and conductive heat transfer.

Yet another object of the invention is to provide counter-flow drum mixer and method of operation for reducing $NO_x$ emissions for processing techniques utilizing both virgin material mixes and RAP with virgin material mixes.

An additional object of the invention is to provide counter-flow drum mixer and method of operation which both reduces in size and operates more economically the air handling equipment and dust collection system required for asphalt production.

Another object of the invention is to provide counter-flow drum mixer and method of operation for which the exhaust gas temperatures are substantially lower than in conventional systems (225 F. average vs. 375 F. average in a typical 50% recycle plant) to permit the use of polyester filters in the dust collection system for a savings of 80% in filter cost over conventional systems.

A further object of the invention is to provide a counter-flow asphalt plant of the character described having improved efficiency of operation and production consistency of finished product conforming to specifications.

An additional object of the invention is to provide a counter-flow asphalt plant of the character described having more precise control over operating parameters to achieve a uniform end-product and more precise control over energy requirements for improved economic operation.

An added object of the invention is to provide a counter-flow asphalt plant of the character described which meets or exceeds modern day environmental standards.

A further object of the invention is to provide a counter-flow asphalt plant of the character described which is both safe and economical in operation. Efficient operation results in improved fuel consumption and in reduced air pollution emissions.

Other and further objects of the invention, together with the features of novelty appurtenant thereto, will appear in the detailed description of the drawings.

In summary, a counter-flow drum mixer asphalt plant equipped with a secondary feeder for introducing RAP to direct radiant heat of the combustion zone. Heated virgin aggregate and RAP in the combustion zone are delivered through a transition piece to a first stage of the mixing zone where liquid asphalt is combined with the materials and secondary combustion air flows through the first stage to evacuate blue smoke and steam back to the combustion zone. The second stage of the mixing zone is substantially isolated from secondary combustion air flow where dust and mineral fines are introduced and mixed to complete the asphalt product discharged from the mixing zone. Alternative constructions of the mixing zone are disclosed to provide the first and second stages having such characteristics, as well as options for both the passive and active control of the secondary combustion air. An optional secondary burner in the exhaust housing elevates the temperature of the exhaust gas above its dew point temperature before delivery to the baghouse.

BRIEF DESCRIPTION OF THE SEVERAL VIEWS OF THE DRAWING

In the following description of the drawings, in which like reference numerals are employed to indicate like parts in the various views.

DETAILED DESCRIPTION OF THE INVENTION

Figure 1:
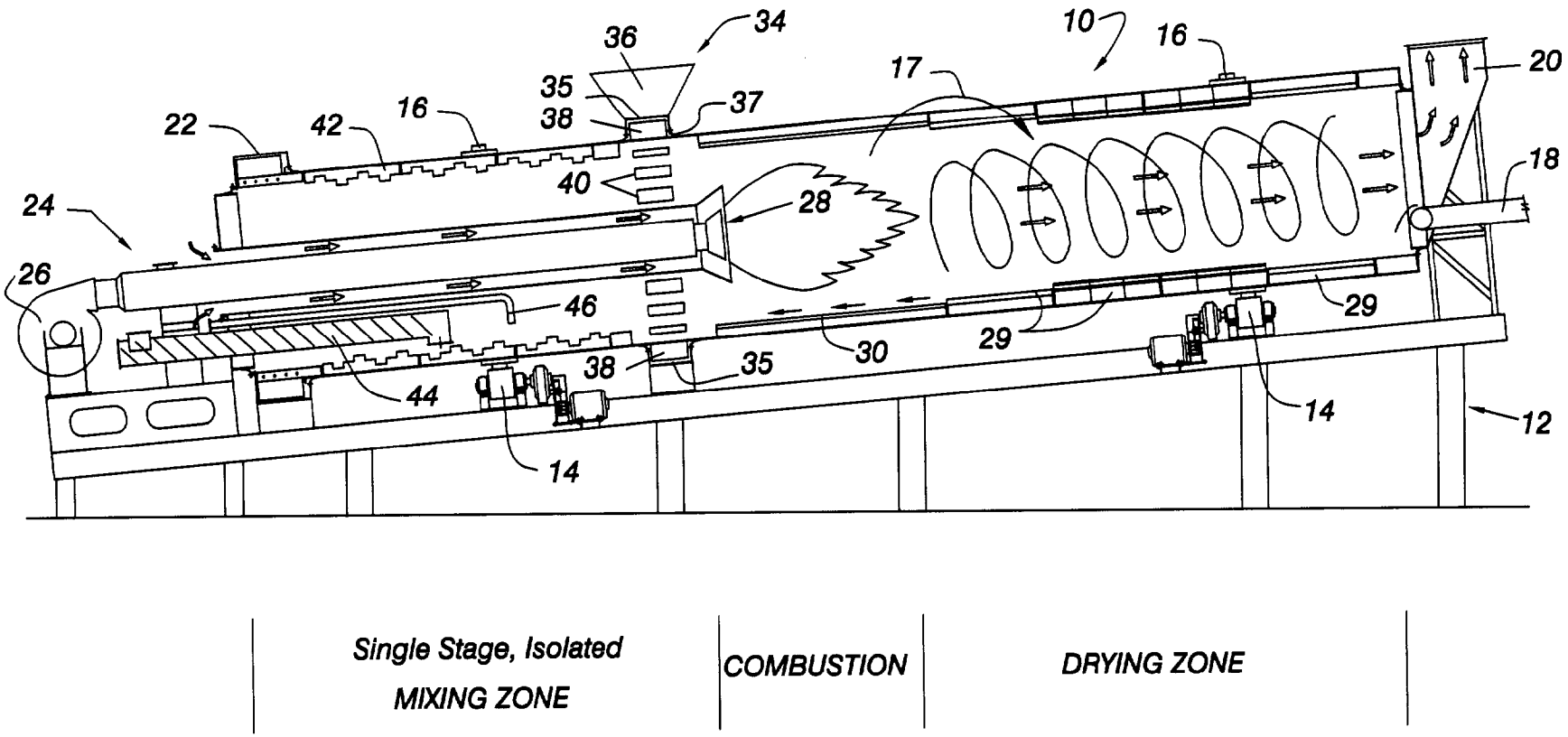
Fig. 1 PRIOR ART
FIG. 1 is a side sectional view of a prior art counter-flow asphalt plant in order to compare and contrast the teachings of this invention.

Referring now to the drawings in greater detail, attention is first directed a modern day counter-flow asphalt plant as shown in the prior art illustration of FIG. 1 for the purpose of subsequently comparing and contrasting the structure and operation of an asphalt plant constructed in accordance with this invention as illustrated in FIGS. 2-13. The prior art asphalt plant of FIG. 1 is shown and described in greater detail in Hawkins U.S. Pat. No. 4,787,938 incorporated herein by reference.

The prior art counter-flow plant includes a substantially horizontal, single drum mixer 10 carried by a ground engaging support frame 12 at a slight angle of declination, typically about 5 degrees. Mounted on the frame 12 are two pairs of large, motor driven rollers 14 which supportingly receive trunnion rings 16 secured to the exterior surface of the drum mixer 10. Thus, rotation of the drive rollers 14 engaging the trunnion rings 16 causes the drum mixer 10 to be rotated about its central longitudinal axis in the direction of the rotational arrow 17.

Located at the inlet or upstream end of the drum mixer 10 is an aggregate feeder 18 to deliver aggregate to the interior of the drum mixer 10 from a storage hopper or stockpile (not shown). The inlet end of the drum mixer 10 is closed by a flanged exhaust port 20 leading to conventional air pollution control equipment (not shown), such as a baghouse, to remove particulates from the gas stream.

Located at the outlet end of the drum mixer 10 is a discharge housing 22 to direct asphaltic composition from the drum mixer 10 to a material conveyor (not shown) for delivery of the final product to a storage bin or transporting vehicle.

A combustion assembly 24 extends through the discharge housing 22 and into the drum mixer 10 to deliver fuel, primary air from a blower 26 and induced secondary air through an open annulus to a burner head 28. In the combustion zone beginning at the burner head 28 there is generated a hot gas stream which flows through the drying zone of the drum mixer 10. Within the drying zone are fixed various types of dryer flights or paddles 29 for the alternative purposes of lifting, tumbling, cascading, veiling, mixing, and moving aggregate within the drum mixer 10 to facilitate the drying and heating of the aggregate therein. Within the combustion zone, on the other hand, the combustion flights 30 are designed primarily to mix and move the aggregate through this section of the drum mixer rather than cause material to cascade or veil through the flame envelope.

Downstream of the burner head 28 in a modern, prior art asphalt plant begins the mixing zone. Within this region is typically located the recycle feed assembly 34 by which recycle asphalt material may be introduced into the drum mixer 10. A stationary box channel 35 encircles the exterior surface of the drum mixer 10 and includes a feed hopper 36 providing access to the interior of the box channel 35. Bolted to the side walls of the box channel 35 are flexible seals 37 to permit rotation of the drum mixer 10 within the encircling box channel 35. Secured to the outer wall of the drum mixer 10 and projecting into the space defined by the box channel 35 are a plurality of scoops 38 radially spaced around the drum mixer 10. At the bottom of each scoop 38 is a scoop opening 40 through the wall of the drum mixer 10 to provide access to the interior of drum mixer 10. Thus, recycle asphalt material may be delivered by conveyor (not shown) through the feed hopper 36, into the box channel 35 and subsequently introduced into the interior of the drum mixer 10 through the scoop openings 40.

Mounted on the interior of the drum mixer 10 and within the mixing zone are staggered rows of sawtooth mixer flighting 42 to mix and stir material within the annulus of the drum mixer 10 and combustion assembly 24. A conveyer or screw auger 44 extends into the drum mixer 10 for feeding binder material or mineral "fines" to the mixing zone. Likewise extending into the drum mixer 10 is an injection tube 46 for spraying liquid asphalt into the mixing zone. At the end of the mixing zone is located the discharge housing 22 as previously discussed through which the asphaltic product is discharged.

Figure 9:
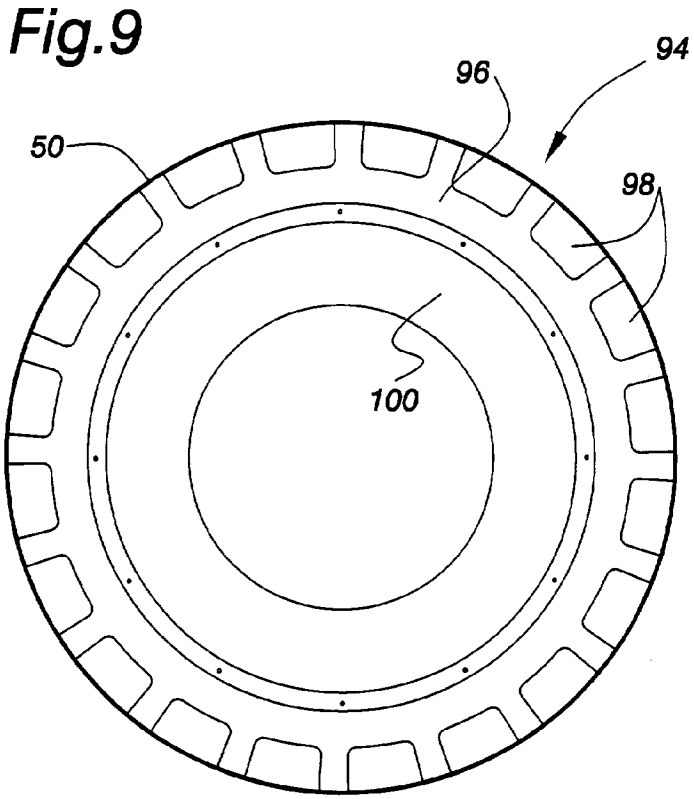
FIG. 9 is an enlarged end sectional view taken along line 9-9 of FIG. 3 in the direction of the arrows to better illustrate the details of the venture cone and support structure at the transition region of the combustion zone to the mixing zone.
Figure 10:
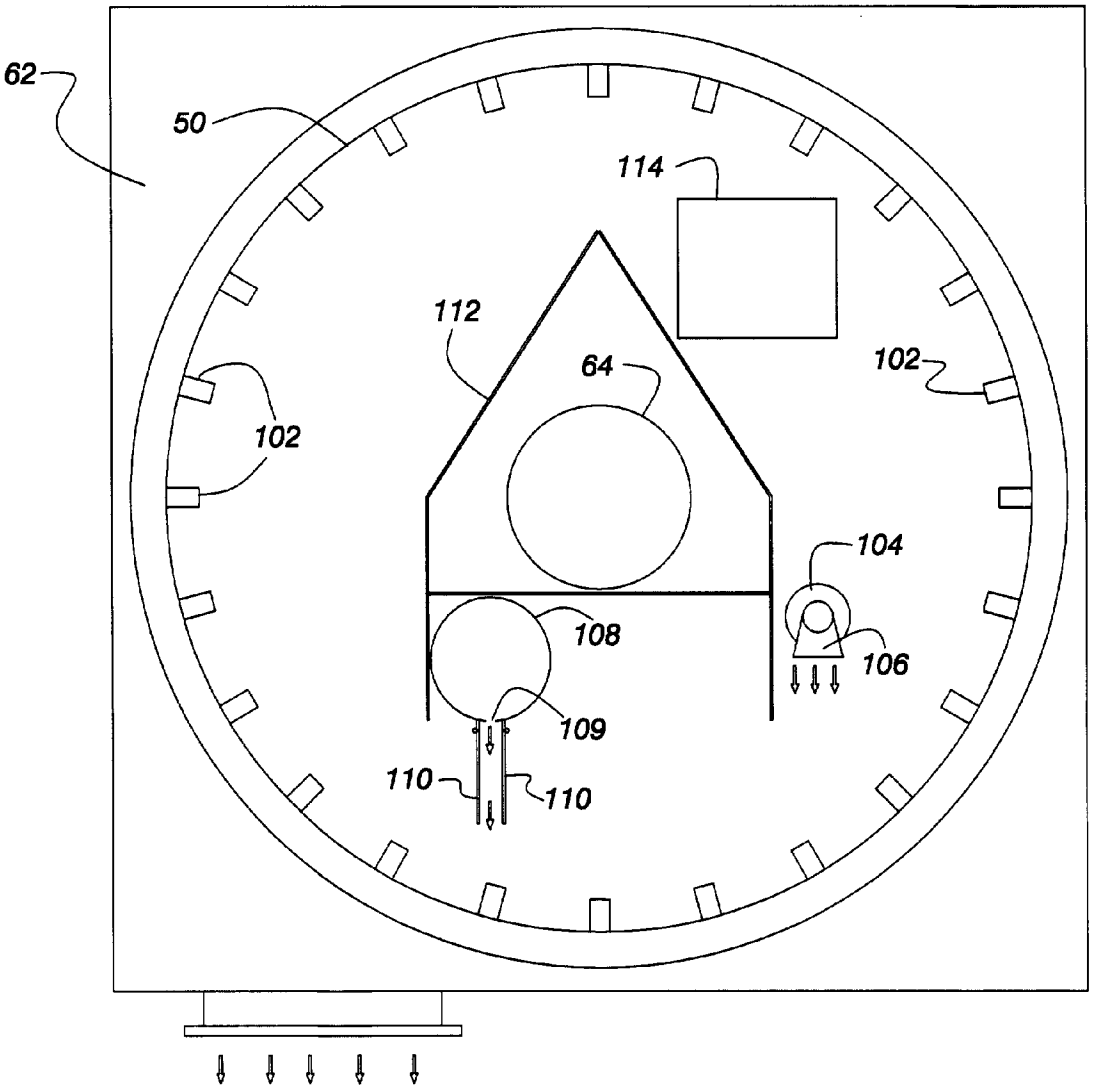
FIG. 10 is an enlarged end sectional view taken along line 10-10 of FIG. 3 in the direction of the arrows to better illustrate the details of the mixing zone.
Figure 11:
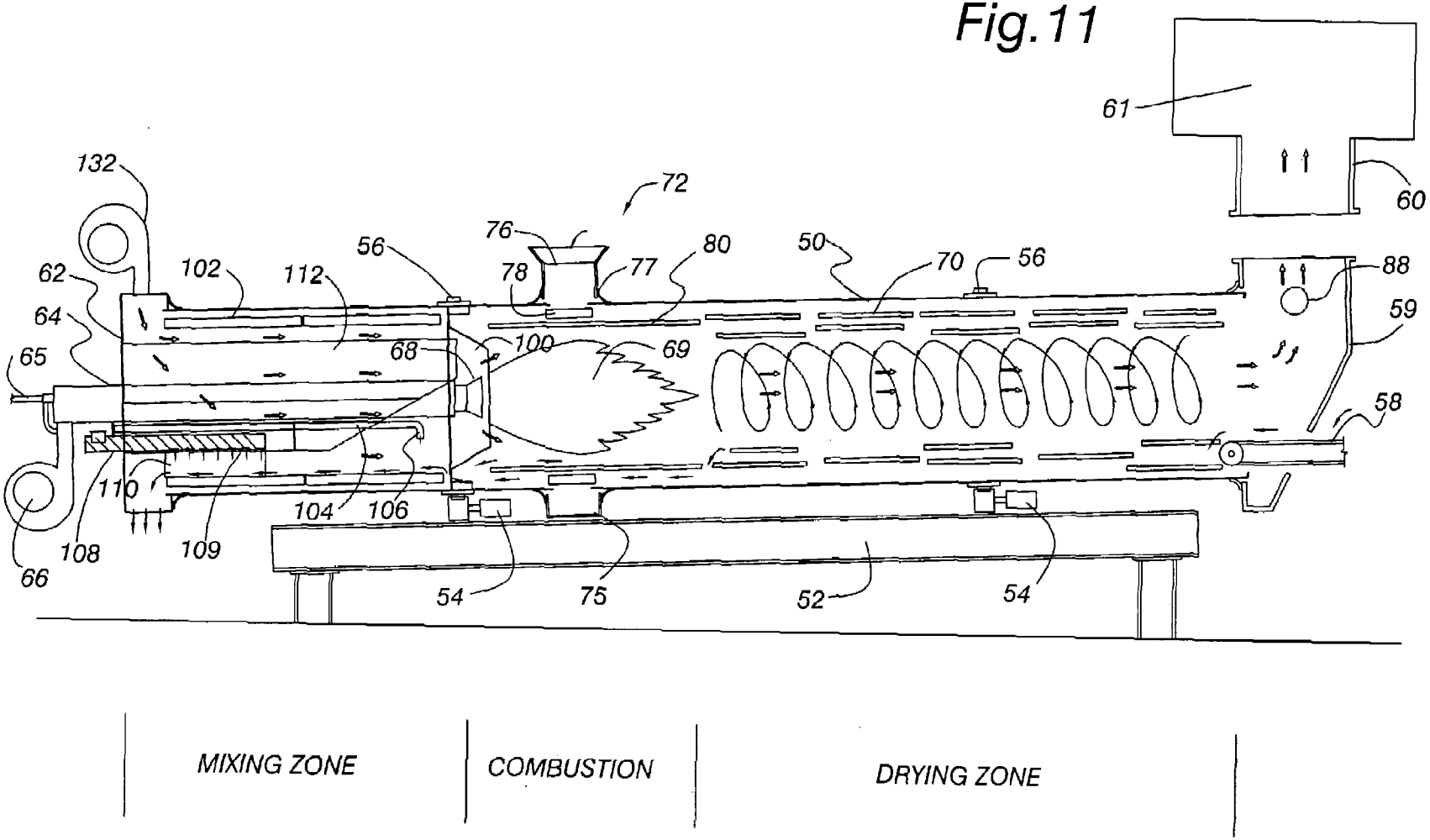
FIG. 11 is a side sectional view of a single drum, counter-flow asphalt plant constructed in accordance with a second preferred embodiment of the invention similar to the asphalt plant of FIG. 3 but with provisions for total control of both primary and secondary combustion air.
Figure 12:
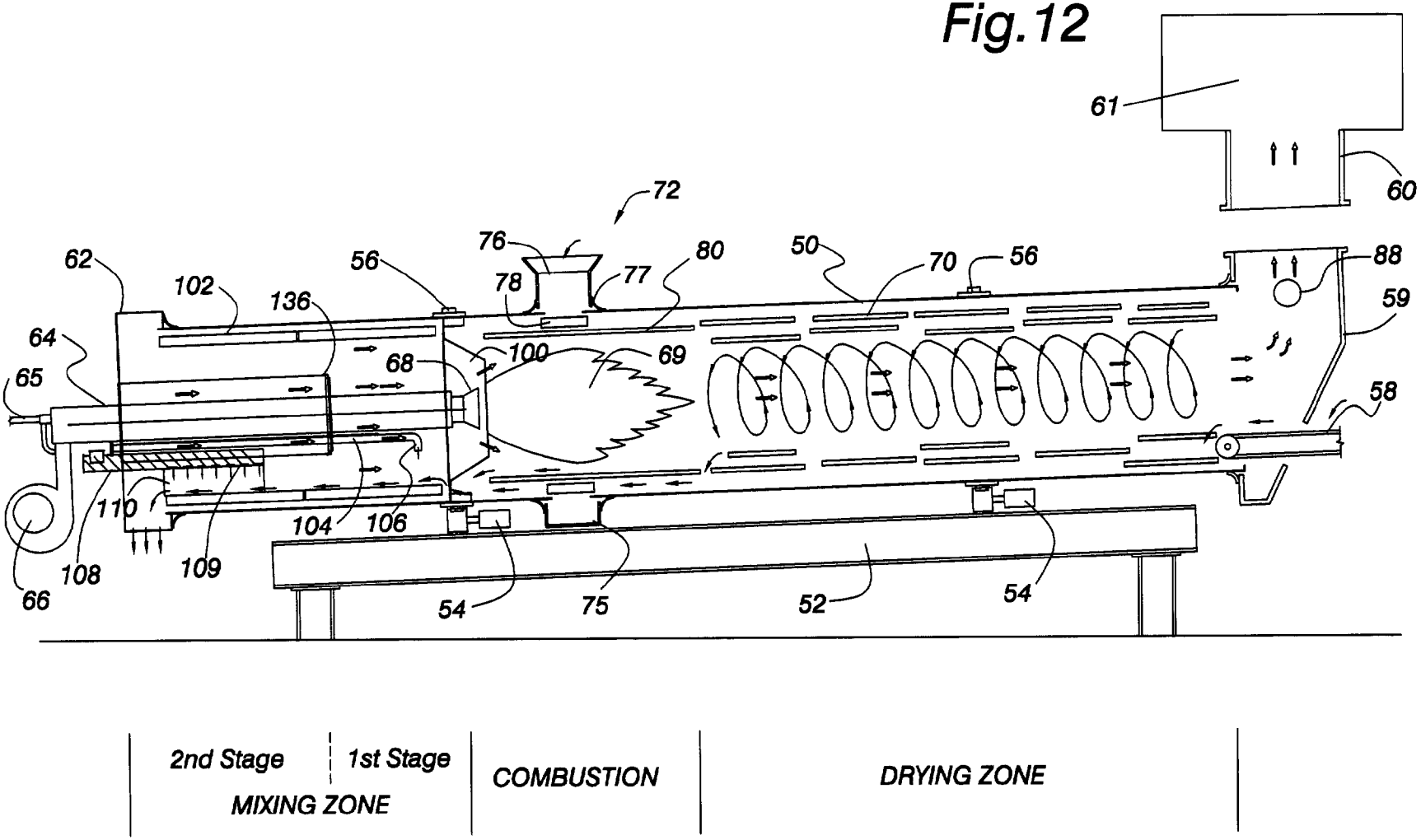
FIG. 12 is a side sectional view of a single drum, counter-flow asphalt plant constructed in accordance with a third preferred embodiment of the invention with a modified mixing zone and aspirated secondary combustion air.
Figure 13:
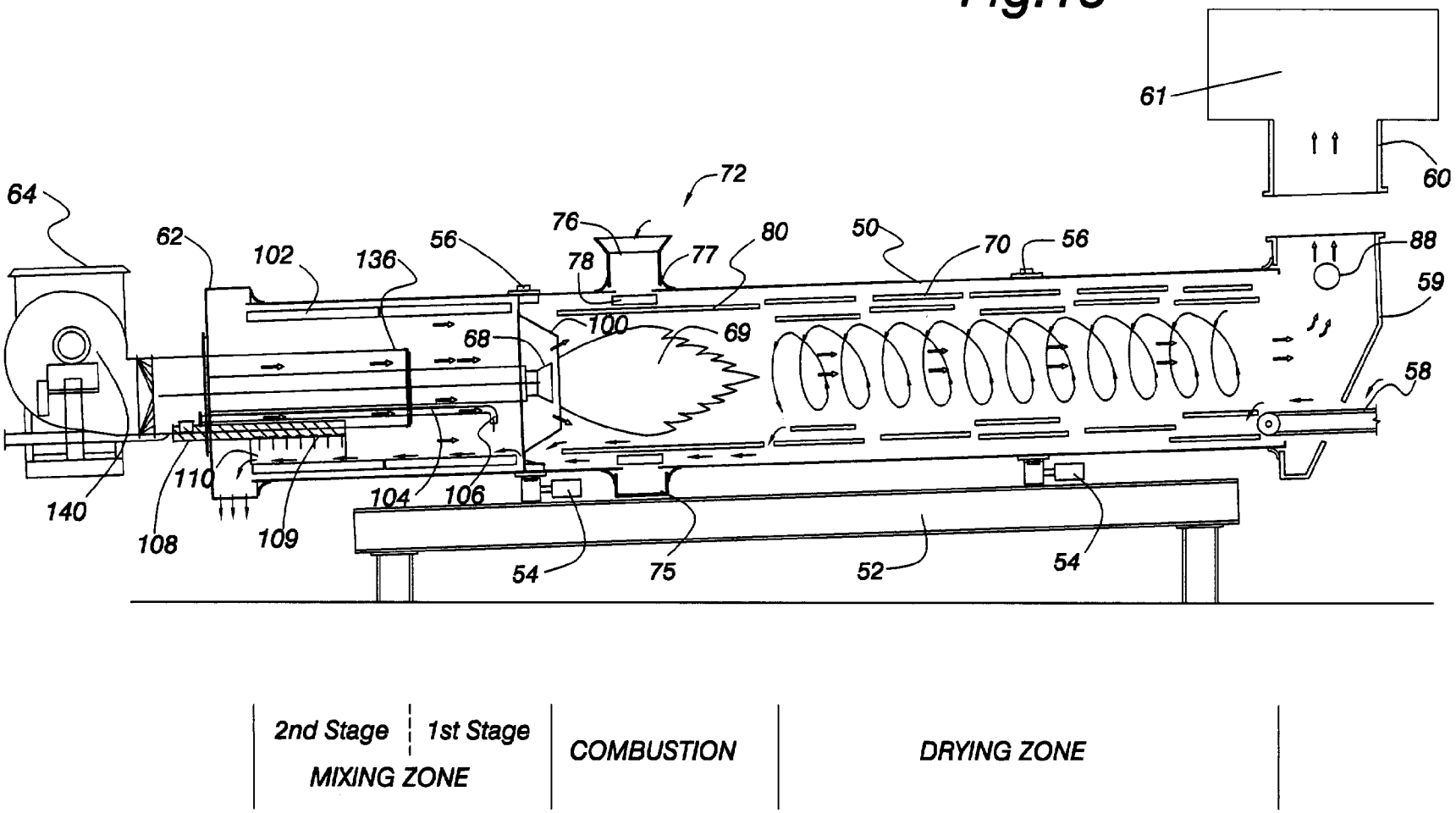
FIG. 13 is a side sectional view of a single drum, counter-flow asphalt plant constructed in accordance with a fourth preferred embodiment of the invention similar to the asphalt plant of FIG. 12 but with provisions for total control of both primary and secondary combustion air.

With the foregoing background in mind, attention is now directed to the counter-flow asphalt plant constructed in accordance with a first preferred embodiment of this invention as illustrated in FIGS. 2-10. As an overview, it should be noted that the inventive features taught herein may be adapted to a variety of asphalt plant equipment configurations. FIGS. 11-13 illustrate modifications of the mixing zone in accordance with the teachings of this invention.

Figures 2, 4:
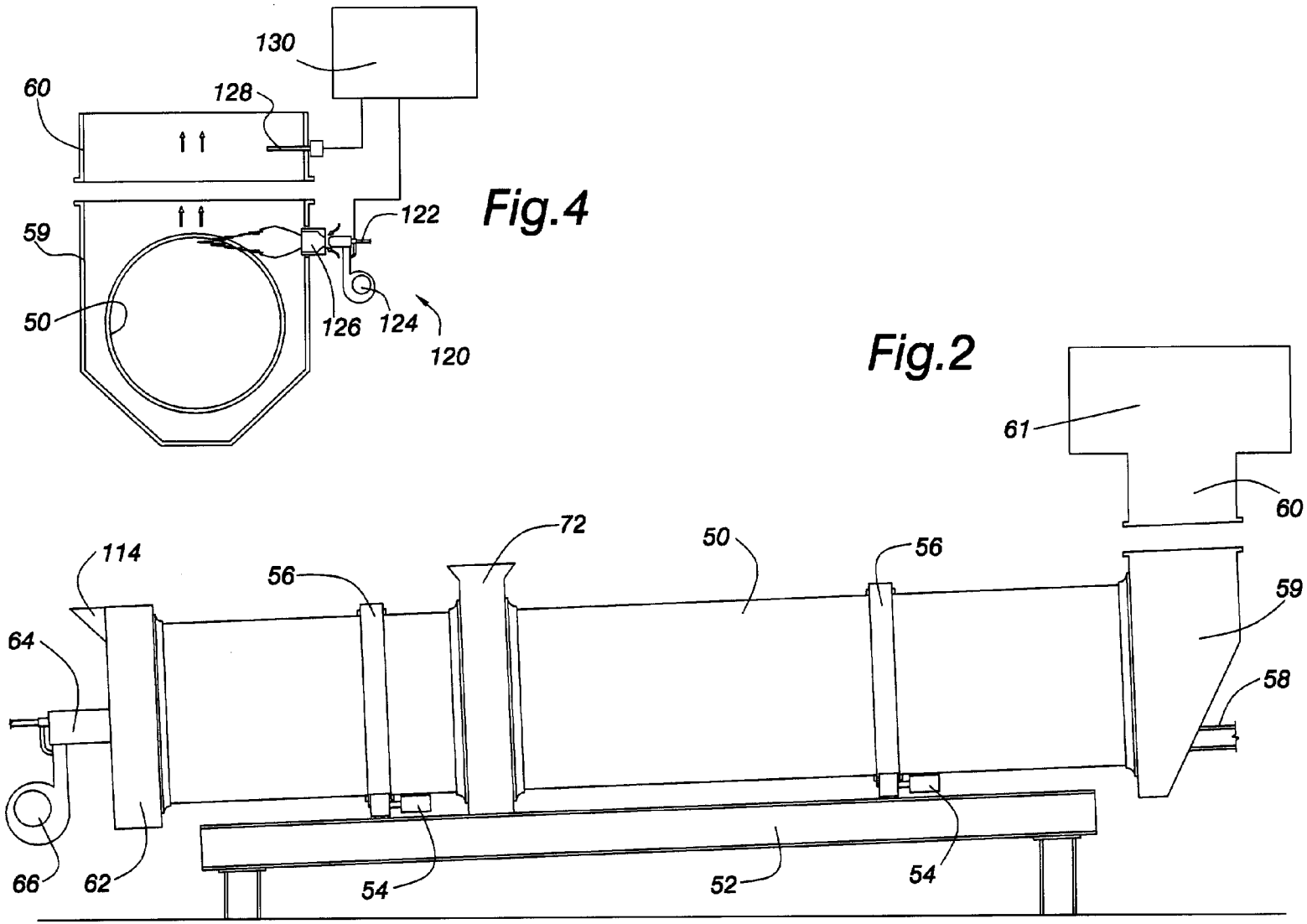
FIG. 2 is a side view of a single drum, counter-flow asphalt plant constructed in accordance with a first preferred embodiment of the invention.
FIG. 4 is an end sectional view of a portion of the exhaust ductwork, the associated exhaust gas heater and a schematic illustration of the temperature control system as taken from the right hand end of FIG. 3.
Figure 3:
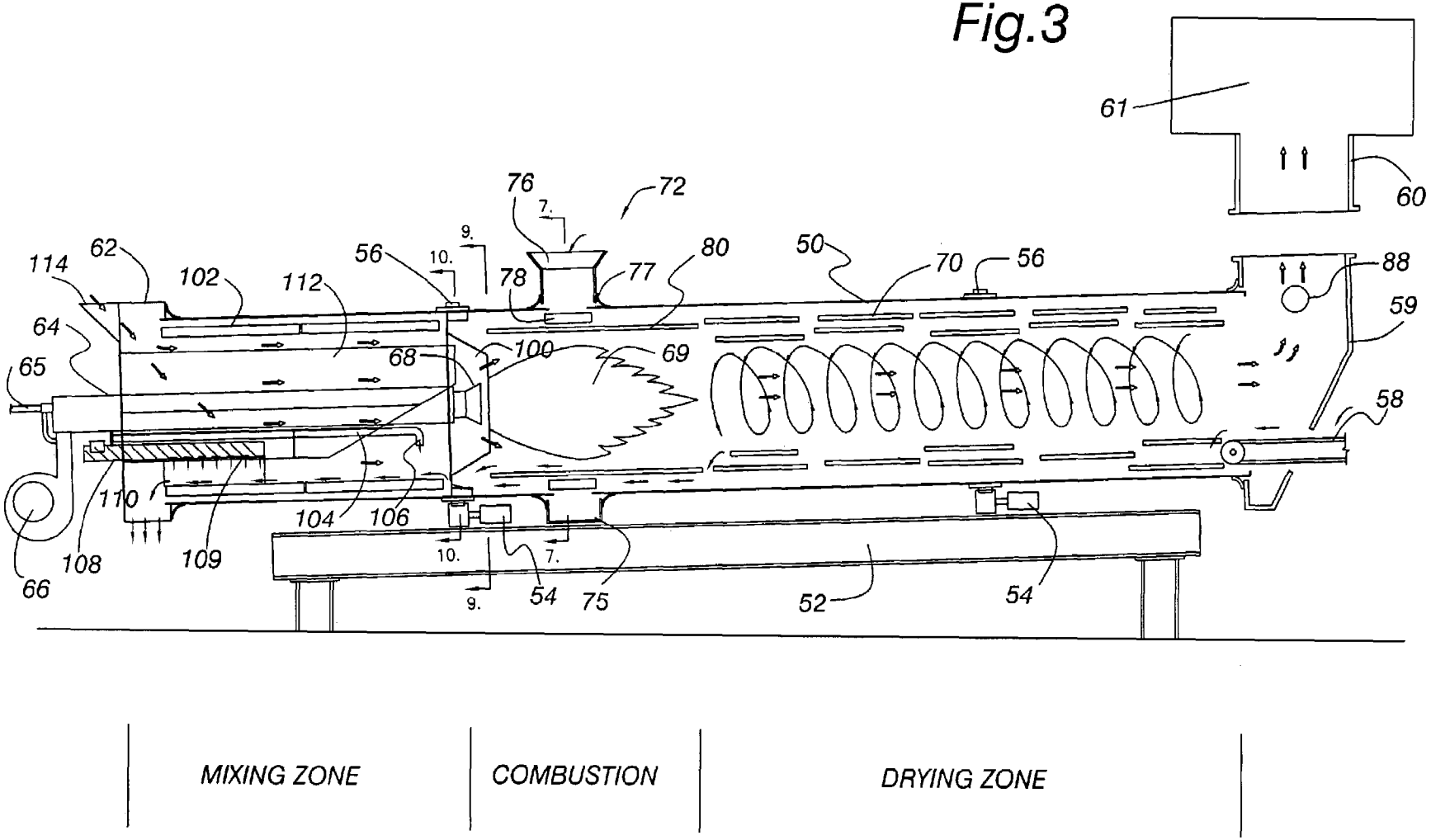
FIG. 3 is a side sectional view of a counter-flow asphalt plant similar to FIG. 2 to better illustrate the details of construction and pertinent operational features of the equipment.

Turning then to the asphalt plant configuration shown in FIGS. 2-4, the counter-flow plant includes a substantially horizontal, single cylindrical drum 50 carried by a ground engaging support frame 52 at a slight angle of declination, typically about 5 degrees. Mounted on the frame 52 are two pairs of large, motor driven rollers 54 which supportingly receive trunnion rings 56 secured to the exterior surface of the drum 50. Thus, rotation of the drive rollers 54 engaging the trunnion rings 56 causes the drum 50 to be rotated about its central longitudinal axis.

Located at the inlet or upstream end of the drum 50 is an aggregate feeder 58 to deliver aggregate to the interior of the drum 50 from a storage hopper or stockpile (not shown). The inlet end of the drum 50 is closed by a flanged exhaust port 59 connected, as is schematically illustrated in FIG. 3, to ductwork 60 leading to conventional air pollution control equipment 61, such as a baghouse, to remove particulates from the exhaust gas stream.

Located at the outlet end of the drum 50 is a discharge housing 62 to direct asphaltic composition from the drum 50 to a material conveyor (not shown) for delivery of the final product to a storage bin or transporting vehicle.

A combustion assembly 64 extends through the discharge housing 62 and into the drum 50 to deliver fuel through fuel line 65 and primary air from a blower 66 to a burner head 68. Combustion of the air and fuel within the combustion zone of the drum 50 which generally extends from the burner head 68 to the end of the flame envelope 69 generates a hot gas stream which flows through the drying zone of the drum 50. Within the drying zone, material flights 70 are secured to the interior surface of the drum 50 to lift, tumble, cascade, veil, mix, and release aggregate material within the drum 50 to create a substantially continuous veil or curtain of falling material through which the hot gas stream passes in counter current flow to facilitate the drying and heating of the aggregate.

Conventional wisdom of asphalt plant design and operation positions the recycle feed downstream of the burner head as illustrated in FIG. 1 in order to deliver the RAP to the isolated mixing zone. Even if the recycle feed is positioned ahead of the burner, prior art asphalt plants add the RAP to an inner shell or with special flighting that shield the recycle material from the flame envelope. After preheating in this manner, the RAP is then delivered to the isolated mixing zone. The present design departs significantly from conventional wisdom in two important ways. First, the recycle feed assembly 72 is located upstream from the burner head 68 and intermediate the ends of the combustion zone, and secondly, the recycle material is introduced and exposed directly to the flame envelope within the combustion zone.

Figure 6:
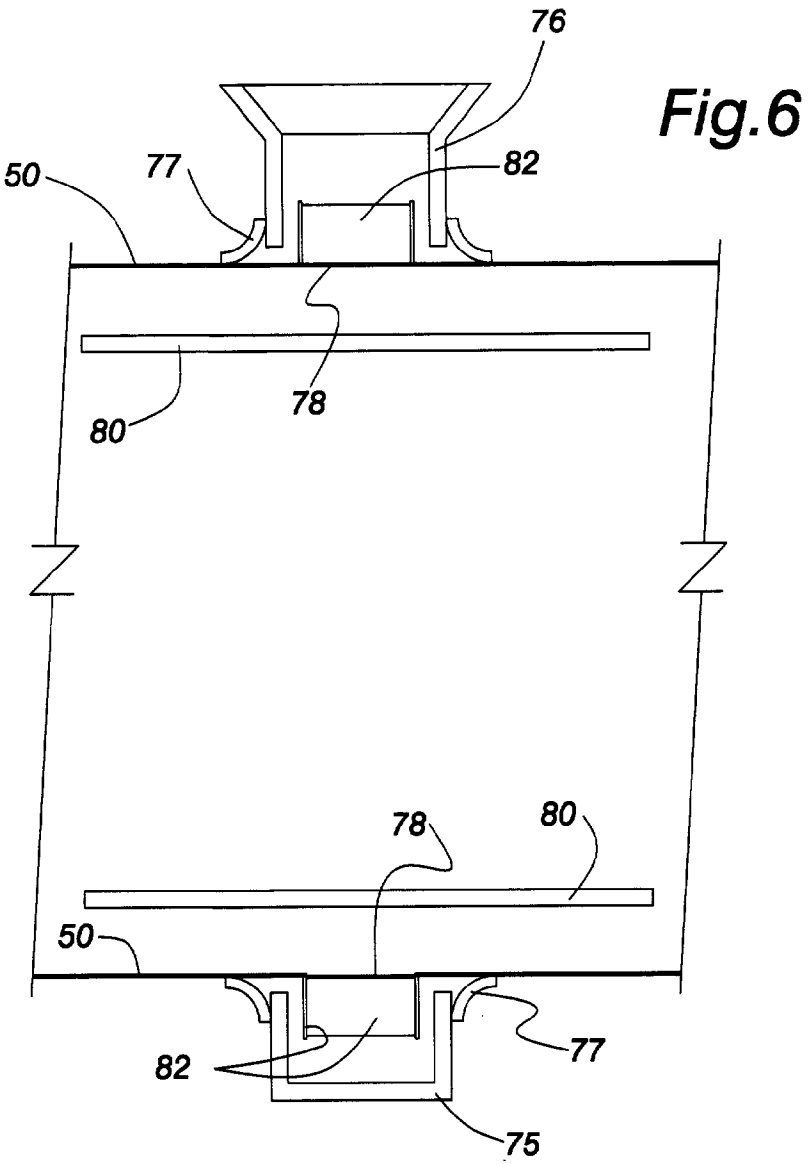
FIG. 6 is an enlarged side sectional view of the combustion zone recycle feed assembly shown in FIG. 5 to better illustrate the internal details of construction.
Figure 5:
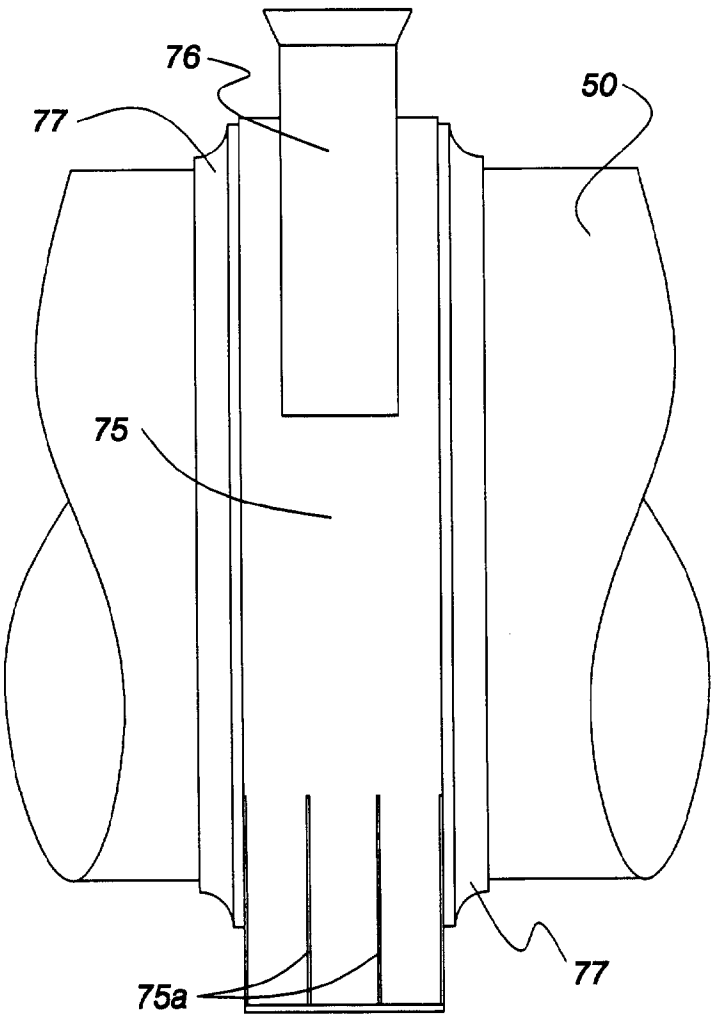
FIG. 5 is an enlarged side view of the combustion zone recycle feed assembly for use with the asphalt equipment disclosed herein.
Figure 7:
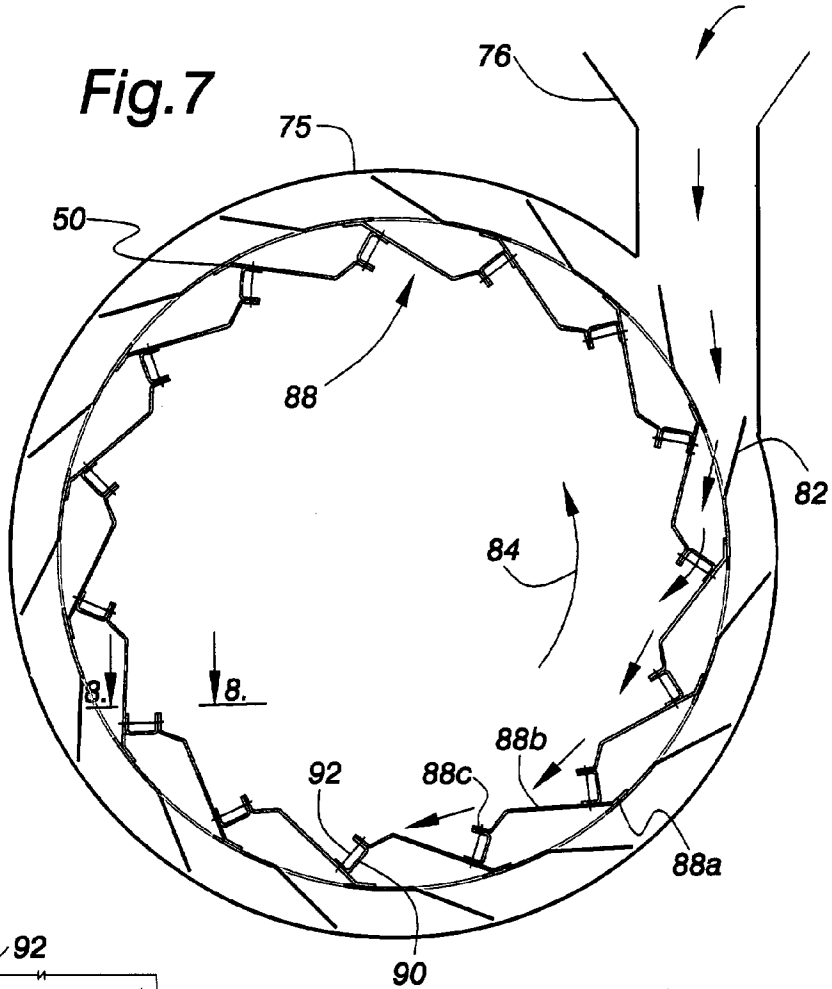
FIG. 7 is an enlarged end sectional view taken along line 7-7 of FIG. 3 in the direction of the arrows to better illustrate the details of the combustion zone flighting in relation to the internal details of the feed collar.

The details of construction of the recycle feed assembly are shown in FIGS. 5-7. A stationary box channel 75 is supported by legs 75*a* to encircle the exterior surface of the drum 50. A feed hopper 76 provides access to the interior of the box channel 75. Bolted to the side walls of the box channel 75 are flexible seals 77 to permit rotation of the drum 50 within the encircling box channel 75. Thus, for example, recycle asphalt material may be delivered by conveyor (not shown) through the feed hopper 76, into the box channel 75 and subsequently introduced into the interior of the drum 50 through scoop openings 78 in the drum shell.

Figure 8:
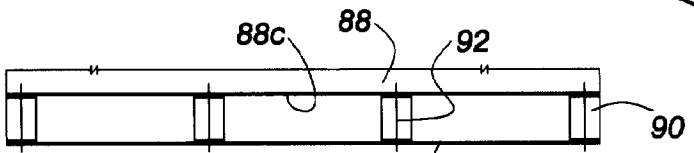
FIG. 8 is an enlarged fragmentary view taken along line 8-8 of FIG. 7 in the direction of the arrows to show the support brackets of the combustion zone flighting.

Within the combustion zone are mounted a plurality of combustion flights that are designated generally by the numeral 80. In contradiction to the teachings of the prior art, the combustion flights are constructed and arranged to deliver the recycle material into the combustion zone for direct exposure to the radiant heat of the flame envelope. Details of the combustion flighting is shown in FIGS. 6-8.

Referring first to FIG. 6, the plurality of circumferential openings 78 through the shell of the drum are registered with the box channel 75. Scoop plates 82 are secured exteriorly of the drum shell 50 to frame three sides of each such opening 78 to direct material falling through the feed hopper 76 from the interior of the box channel 75 through an opening 78 into the interior of the drum shell 50. Note that a set of scoop plates 82 framing any opening 78 form a mouth which is open in the direction of rotation of the drum 50 as indicated by the arrow 84 (FIG. 7).

Secured to the interior surface of the drum shell 50 in the combustion zone, substantially parallel to the rotational axis of the drum, are the combustion flights 80. Each combustion flight 80 includes an elongate flighting web 88 which has an angled leading lip 88*a* bent with respect to the main body portion 88*b*, and an angled trailing lip 88*c* directed interiorly of the drum 50 from the main body portion 88*b*. The leading lip 88*a* of each flighting web 88 is connected to the interior surface of the drum 50. As best shown in FIG. 8, the trailing lip 88*c* of one flighting web 88 is held apart from the nearest adjacent flighting web 88 by a plurality of clip brackets 90 spaced longitudinally along the length of the flighting web 88. For each such clip bracket 90, a pin 92 interconnects the trailing lip 88*c* to the clip bracket 90 and then to the main body portion 88*b* of the adjacent flighting web 88. Thus, the trailing lip 88*c* of one flighting web 88 overlies the leading lip 88*a* of the next adjacent flighting web 88 and is held apart by the clip brackets 90 and pins 92 to provide an elongate slot opening between successive webs 80.

Accordingly, as illustrated by the material flow arrows of FIG. 7, recycle materials delivered through the feed hopper 76 are directed by the scoop plates 82 through the openings 78 in the drum shell 50, then through the slots formed between successive combustion flighting webs 88 and into the combustion zone for direct exposure to radiant heat of the flame envelope. Since the RAP experiences radiant, convective and conductive heat transfer, it is important to limit the residence time of the RAP within the combustion zone. For this reason, the distance between the recycle feed assembly 72 and the mixing zone is limited to a range of 2 to 8 feet, and preferably falls in the range of 3 to 5 feet. Any blue smoke generated as a result of operation in this manner can be incinerated in the flame envelope 69.

Downstream of the burner head 68 is the mixing zone within the drum 50 which is separated from the combustion zone by a transition member as shown in FIG. 9 and designated generally by the numeral 94. The transition piece 94 includes an annular collar 96 secured to the interior wall of the drum shell 50. The collar 96 includes radially spaced openings 98 around the periphery of the collar at the drum shell 50 to permit aggregate and RAP material to pass from the combustion zone to the mixing zone. Secured adjacent the inside diameter of the collar 96 is a frusto-conical venturi 100 which is concentrically aligned with the longitudinal axis of the drum 60 and which uniformly tapers from a larger diameter at the collar 96 to a smaller diameter in the direction toward the combustion and drying zones. The venture 100 terminates proximate the burner head 68 for the purpose, as will be seen, of channeling secondary combustion air, blue smoke and steam from the mixing zone into the flame envelope 69 within the combustion zone.

The mixing zone of the present invention is operationally subdivided into two subzones or stages which can most conveniently be thought of as a first region wherein liquid asphalt is added to the aggregate and RAP materials, and a second region wherein the final product components of binder dust or mineral "fines" are added to the mixture of aggregate, RAP and liquid asphalt. Therefore, the first stage of the mixing zone extends generally from the combustion zone to point where fines are added, and the second stage of the mixing zone extends generally from the point where fines are added to the discharge of the final product.

Throughout the mixing zone and mounted to the interior of the drum shell 50 are rows of mixer flighting 102 to mix and stir material within the annulus formed generally between the drum 50 and combustion assembly 64. Through the rear wall of the discharge housing 62 extends an injection tube 104 for spraying liquid asphalt into the first stage of the mixing zone. Thus, the spray head 106 of the injection tube 104 is positioned just downstream of the transition piece 94.

Closer to the product discharge, a screw auger 108 extends through the rear wall of the discharge housing 62. Typically, a screw auger is a hollow pipe in which a spiral flight is rotated to carry material through the pipe and out one end. Screw auger 108 of this invention is atypical. From the discharge end and along a length of the auger pipe are a plurality of elongate slots 109 in the bottom of the pipe to permit the discharge of dust and fines along a substantial length of the auger 108 when the spiral flight is rotated within the auger pipe. Moreover, mounted to the auger pipe 108 along opposite sides of the discharge slots therein are a pair of spaced apart, flexible flaps 110 which hang downwardly from the auger 108 into the mixing zone as shown in FIG. 10. The foregoing features result in better mixing of the fines into the final product and minimize entrainment of the fines into the air of the mixing zone.

As shown in FIGS. 3 & 10, a stationary teepee housing 112 is mounted within the mixing zone, generally above the combustion assembly 64 to shield same from any sticky asphaltic composition that might fall from above while the material components are mixed within the mixing zone and to assist in isolating the second stage of the mixing zone where the dust and fines are added to the mix. The teepee housing is substantially sealed against the rear wall of the discharge housing 62. Above the teepee housing 112, a secondary combustion air inlet 114 penetrates the discharge housing 62 to permit the free flow of air into the mixing zone above the teepee housing 112. The air inlet 114 may be optionally fitted with a damper to partially regulate air flow through the inlet 114.

During plant operations, combustion at the burner head 68 is principally supported by the fuel and primary air, but secondary combustion air is introduced through the inlet 114 and eventually reaches the burner head 68 to also support combustion. As a result of the arrangement of the features previously described, the second stage of the mixing zone is unaffected by the flow of secondary combustion air. In other words, the region of the second stage of the mixing zone where the dust and fines are added is substantially isolated from air flow by location, the teepee housing 112, and the flexible flaps 110 of the screw auger 108. On the other hand, the first stage of the mixing zone where the liquid asphalt is added and where blue smoke and steam may be present are effectively swept by the secondary combustion air into the combustion zone so that the blue smoke can be incinerated by the flame envelope 69. Thus, dust entrainment in the mixing zone is minimized and any blue smoke and steam is evacuated to the combustion zone rather than being discharged with the final product.

Unlike conventional counter-flow asphalt plants, the asphalt plant of this invention optionally includes an exhaust gas burner. Attention is now directed to the upstream portion of FIG. 3 and the end view of FIG. 4. A second combustion assembly 120 extends through the exhaust port housing 59 and into the exhaust gas stream to deliver fuel through supply line 122 and primary air from a blower 124 to a burner head 126. Combustion at the burner head 126 heats the exhaust gas stream to elevate the temperature thereof before delivery to the baghouse 61. It is desirable to maintain the temperature of the exhaust gas stream at or above its dew point prior to entry to the air pollution filtration equipment 61. More or less energy may be supplied to the exhaust gas stream by process control equipment known to those skilled in the art. Illustrated in the drawings is a schematic representation of one example which includes a temperature sensing thermocouple 128 installed in the exhaust port housing 59 or ductwork 60 of the baghouse 61. The thermocouple 128 is operatively connected to a process controller 130 which, in turn, is connected to the combustion assembly 120 for regulation of the fuel and air supply to support combustion in the exhaust gas stream.

FIG. 11 shows a single drum, counter-flow asphalt plant constructed in accordance with a second preferred embodiment of the invention that is similar to the asphalt plant of FIGS. 3-10 but with provisions for total control of both primary and secondary combustion air. In general, the structural details of the FIGS. 3-10 and FIG. 11 plants are the same except for the provision of secondary air to the mixing zone. Instead of the secondary air inlet 114 and the operationally free flow of secondary air as in the FIGS. 3-10 configuration, the discharge housing 62 in FIG. 11 is fitted above the teepee structure 112 with a secondary air blower 132 to forcibly deliver secondary combustion air to the mixing zone. The effect of the secondary air flow is essentially the same as the previous description. In other words, the region of the second stage of the mixing zone where the dust and fines are added is substantially isolated from air flow by location, the teepee housing 112, and the flexible flaps 110 of the screw auger 108. On the other hand, the first stage of the mixing zone where the liquid asphalt is added and where blue smoke and steam may be present are effectively swept by the secondary combustion air into the combustion zone so that the blue smoke can be incinerated by the flame envelope 69. Thus, dust entrainment in the mixing zone is minimized and any blue smoke and steam is positively evacuated to the combustion zone rather than being discharged with the final product.

FIG. 12 shows a single drum, counter-flow asphalt plant constructed in accordance with a third preferred embodiment of the invention that is similar to the two previous embodiments but with a modified mixing zone and aspirated secondary combustion air. Comparing the plant of FIG. 3 with that of FIG. 12, the teepee housing 112 and air inlet 114 are absent but the remaining features are the same. In FIG. 12, a large diameter secondary air tube 136 extends through the discharge housing 62 into the mixing zone. The tube 136 terminates intermediate the asphalt spray head 106 and the auger 108 to better define the transition between the first and second stages of the mixing zone. The combustion assembly 64 extends through the tube 136 and forms an open annulus therewith through which ambient air flow is induced during combustion operations.

As shown, the secondary air tube 136 also serves to shield the combustion assembly 64 from any sticky asphaltic composition that might fall from above while the material components are mixed within the mixing zone and to effectively isolate the second stage of the mixing zone where the dust and fines are added to the mix.

During plant operations, combustion at the burner head 68 is principally supported by the fuel and primary air, but secondary combustion air is introduced through the tube 136 and eventually reaches the burner head 68 to also support combustion. As a result of the arrangement of the features previously described, the second stage of the mixing zone is unaffected by the flow of secondary combustion air. In other words, the region of the mixing zone where the dust and fines are added is substantially isolated from air flow by location, the secondary air tube 136, and the flexible flaps 110 of the screw auger 108. On the other hand, the first stage of the mixing zone where the liquid asphalt is added and where blue smoke and steam may be present are effectively swept by the secondary combustion air into the combustion zone so that the blue smoke can be incinerated by the flame envelope 69. Thus, dust entrainment in the mixing zone is minimized and any blue smoke and steam is evacuated to the combustion zone rather than being discharged with the final product.

FIG. 13 shows a single drum, counter-flow asphalt plant constructed in accordance with a fourth preferred embodiment of the invention similar to the asphalt plant of FIG. 12 but with provisions for total control of both primary and secondary combustion air. Here, the secondary air tube 136 is connected to a positive displacement blower 140 with separate controls to provide and independently regulate both primary and secondary air. Otherwise, the internals of the drum 50 are the same as described with reference to FIG. 12.

The foregoing features of the invention both individually and in combination offer remarkable benefits to modern asphalt plant design, construction and operations. RAP material is introduced directly into the hottest area of the drum and directly exposed to radiant heat of the flame envelope. High percentage RAP mixes (up to 50%) are now possible without excessive equipment shell temperatures or excessive exhaust gas temperatures. The limited residence time in the combustion zone generally keeps the RAP below the smoke point, but any blue smoke formed in the combustion zone can still be incinerated without passing into the baghouse because the feed entry is positioned intermediate the ends of the combustion zone.

The recycle feed assembly can also be used to introduce both RAP material, virgin material or a combination of both in order to reduce $NO_x$ emissions. This is achieved by introducing the wet materials (RAP or virgin) at the hot part of the combustion zone. The steam produced by the moisture laden material acts to cool the combustion zone hereby reducing the formation of thermally produced $NO_x$.

Provision of a secondary burner for the exhaust gas stream permits precision control of the exhaust gas temperatures for maximum fuel efficiency. Equipment life is extended by eliminating the need to superheat virgin aggregates. Highly efficient heat transfer in the heating/drying zone of asphalt plant permits operations with the gas in the drying zone to sink as low as 180° F. with energy addition prior to delivery of the gas to the baghouse at or above its dew point in the range of 225° F. The plant operator can now standardize on the use of use of polyester bags (275° F. maximum service) rather than NOMEX (375° F. maximum service) bags to achieve a cost reduction of approximately 80%.

Likewise, the features of this invention alternatively permit either increased production or decreased sizes of the equipment required for a given production rate because both the BTU and CFM requirements are reduced as a result of the lower stack temperature. These highly significant advantages and benefits can be understood with reference to the following sizing calculations table.

SIZING CALCULATIONS TABLE

Calculation Assumptions: Counter-flow Drum, 650' Elevation, #2 Fuel Oil, 5% Moisture, 320° F. Mix, 900 FPM Drum Throughput, 3500 FPM Inlet Duct, 4400 FPM Stack

| TPH | BTU'S × 1,000,000 | DRYER DIA. | INLET DUCT DIA. | BAGHOUSE SIZE | STACK DIA. |
|---|---|---|---|---|---|
| | | | 375 DEGREE STACK: | | |
| 200 | 55.91 | 87.5" | 44.5" | 37,500 ACFM | 39.5" |
| 300 | 83.87 | 107" | 54.25" | 56,200 ACFM | 48.5" |
| **400** | **111.83** | **123.5"** | **62.75"** | **74,900 ACFM** | **56"** |
| 500 | 139.79 | 138" | 70" | 93,600 ACFM | 62.5" |
| 600 | 167.74 | 151.5" | 76.75" | 112,400 ACFM | 68.5" |
| | | | 300 DEGREE STACK: | | |
| 200 | 53.25 | 82" | 41.5" | 33,000 ACFM | 37" |
| 300 | 79.87 | 100.5" | 51" | 49,500 ACFM | 45.5" |
| **400** | **106.49** | **116"** | **58.75"** | **65,900 ACFM** | **52.5"** |
| 500 | 133.12 | 129.5" | 65.75" | 82,400 ACFM | 58.5" |
| 600 | 159.74 | 142" | 72" | 98,900 ACFM | 64" |
| | | 225 DEGREE STACK: 180 DEGREES DRYER EXHAUST GAS TEMPERATURE: | | | |
| 200 | 50.74 | 73.5" | 39" | 28,800 ACFM | 34.75" |
| 300 | 76.11 | 89.75" | 47.5" | 43,100 ACFM | 42.5" |
| **400** | **101.48** | **103.5"** | **55"** | **57,500 ACFM** | **49"** |
| 500 | 126.85 | 115.75" | 61.5" | 71,900 ACFM | 54.75" |
| 600 | 152.22 | 127" | 67" | 86,200 ACFM | 60" |

By utilizing both the unique combustion entry RAP system combined with a dual burner configuration, in the example of a 50% recycle plant, such a system has a reduced size of the air handling equipment, including the dust collection system, by 20%, and the combustion equipment by 10%.

The size of the typical 400 ton per hour drum/dryer, for example, goes from 10'-3" diameter to 8'-8" diameter. The size of the baghouse filter collector on the same plant goes from a 75,000 ACFM capacity requirement to a 57,500 ACFM requirement. The size of the burner goes from 112 million BTU down to 101 million BTU. Such savings are heretofore unknown for modern asphalt plants.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

NUMERALS

Prior Art drum mixer 10 support frame 12 motor driven rollers 14 trunnion rings 16 rotational arrow 17 aggregate feeder 18 exhaust port 20 discharge housing 22 combustion assembly 24 blower 26 burner head 28 dryer flights 29 combustion flights 30 recycle feed assembly 34 stationary box channel 35
feed hopper 36
flexible seals 37
scoops 38
scoop opening 40 sawtooth flighting 42 screw auger 44 injection tube 46

Invention cylindrical drum 50 support frame 52 drive rollers 54 trunnion rings 56 aggregate feeder 58 exhaust port 59 ductwork 60 air pollution control equipment 61 discharge housing 62 combustion assembly 64
fuel line 65
blower 66 burner head 68 flame envelope 69 dryer flights 70 recycle feed assembly 72
box channel 75
support legs 75*a*
feed hopper 76
flexible seals 77
scoop openings 78 combustion flighting 80 scoop plates 82 rotational arrow 84 flighting web 88
angled leading lip 88*a*
main body portion 88*b*
angles trailing lip 88*c* clip bracket 90 pin 92 transition member 94
annular collar 96
radially spaced openings 98
venturi 100 mixer flighting 102 injection tube 104
spray head 106 screw auger 108
elongate slots 109
flexible flaps 110 teepee housing 112 secondary combustion air inlet 114 secondary combustion assembly 120
fuel supply line 122
blower 124
burner head 126
thermocouple 128
process controller 130

FIG. 11 secondary air blower 132

FIG. 12 secondary air tube 136

FIG. 13 positive displacement blower 140

Having thus described my invention, I claim:

1. A counter-flow drum mixer asphalt plant for producing asphaltic product from aggregate and liquid asphalt, said asphalt plant comprising:

a rotatable cylinder having first and second ends with an internal passageway communicating therebetween and serially providing zones therein from said first end to said second end defined progressively as a drying zone, a combustion zone and first and second stage mixing zones;

a support framework carrying said cylinder in a substantially horizontal orientation;

a drive motor mounted on said framework and engaged with said cylinder to rotate said cylinder about the central longitudinal axis thereof;

a primary aggregate feeder with a material discharge extending within said first end of said cylinder to deliver aggregate material to said drying zone of said cylinder whereby rotation of said cylinder transports said aggregate material progressively through said drying, combustion and first and second stage mixing zones to said second end of said cylinder;

a combustion assembly projected into the second end of said cylinder and extending through said first and second stage mixing zones to said combustion zone to generate a hot gas stream in said combustion zone to flow through said combustion and drying zones toward said first end of said cylinder in a countercurrent direction to the flow of aggregate material within said cylinder in order to heat and dry the aggregate material within said combustion and drying zones, said combustion assembly including a burner head positioned at said combustion zone, a fuel supply connected to said burner head, and a primary combustion air supply connected to said burner head to establish a combustion flame within said combustion zone of said cylinder;

a liquid asphalt feeder disposed within said first stage mixing zone for delivering liquid asphalt to the hot aggregate carried from the combustion zone into said first stage mixing zone to form an asphaltic composition;

a dust feeder disposed within said second stage mixing zone for delivering fine additives to said asphaltic composition carried from said first mixing zone to form a finished asphaltic product;

a stationary discharge housing sealingly connected to said second end of said cylinder to permit rotation thereof and having a discharge port for discharging said finished asphaltic product from said cylinder; and a secondary combustion air supply connected to said discharge housing to direct a flow of secondary combustion air to said first stage mixing zone in order to evacuate and carry blue smoke and steam vapors from said first stage mixing zone into said combustion zone and to substantially isolate said second stage mixing zone from the flow of secondary combustion air in order to minimize entrainment of fine additives from said second stage mixing zone.

2. The counter-flow drum mixer asphalt plant as in claim 1, said secondary combustion air supply including an opening in said discharge housing to admit ambient air and a conduit member associated with said opening to direct air flow to said first stage mixing zone and to substantially shield said second stage mixing zone from air flow.

3. The counter-flow drum mixer asphalt plant as in claim 2, said conduit member comprising a teepee shield interposed between said opening in said discharge housing and said dust feeder.

4. The counter-flow drum mixer asphalt plant as in claim 2, said conduit member comprising a cylindrical tube connected to said opening in said discharge housing and extended through said second stage mixing zone to deliver secondary combustion air to said first stage mixing zone.

5. The counter-flow drum mixer asphalt plant as in claim 1, said dust feeder comprising a tubular auger having a plurality of discharge openings along the length thereof to deliver fine additives and a pair of flexible shields suspended from said tubular auger along opposite sides of said discharge openings to direct fine additives downwardly to said asphaltic composition within said second stage mixing zone.

6. A counter-flow drum mixer asphalt plant for producing asphaltic product from aggregate, RAP, and liquid asphalt, said asphalt plant comprising:

a rotatable cylinder having first and second ends with an internal passageway communicating therebetween and serially providing zones therein from said first end to said second end defined progressively as a drying zone, a combustion zone and first and second stage mixing zones;

a support framework carrying said cylinder in a substantially horizontal orientation;

a drive motor mounted on said framework and engaged with said cylinder to rotate said cylinder about the central longitudinal axis thereof;

a primary aggregate feeder with a material discharge extending within said first end of said cylinder to deliver aggregate material to said drying zone of said cylinder whereby rotation of said cylinder transports said aggregate material progressively through said drying, combustion and first and second stage mixing zones to said second end of said cylinder;

a combustion assembly projected into the second end of said cylinder and extending through said first and second stage mixing zones to said combustion zone to generate a hot gas stream in said combustion zone to flow through said combustion and drying zones toward said first end of said cylinder in a countercurrent direction to the flow of aggregate material within said cylinder in order to heat and dry the aggregate material within said combustion and drying zones, said combustion assembly including a burner head positioned at said combustion zone, a fuel supply connected to said burner head, and a primary combustion air supply connected to said burner head to establish a combustion flame within said combustion zone of said cylinder;

a recycle feeder to introduce RAP into said combustion zone of said cylinder;

a liquid asphalt feeder disposed within said first stage mixing zone for delivering liquid asphalt to the hot aggregate and RAP material carried from the combustion zone into said first stage mixing zone to form an asphaltic composition;

a dust feeder disposed within said second stage mixing zone for delivering fine additives to said asphaltic composition carried from said first mixing zone to form a finished asphaltic product;

a stationary discharge housing sealingly connected to said second end of said cylinder to permit rotation thereof and having a discharge port for discharging said finished asphaltic product from said cylinder; and a secondary combustion air supply connected to said discharge housing to direct a flow of secondary combustion air to said first stage mixing zone in order to evacuate and carry blue smoke and steam vapors from said first stage mixing zone into said combustion zone and to substantially isolate said second stage mixing zone from the flow of secondary combustion air in order to minimize entrainment of fine additives from said second stage mixing zone.

7. The counter-flow drum mixer asphalt plant as in claim 6, said recycle feeder located from said first stage mixing zone a distance within the range of 2 to 8 feet in order to limit the residence time of said RAP material within said combustion zone before delivery to said first stage mixing zone.

8. The counter-flow drum mixer asphalt plant as in claim 6, said secondary combustion air supply including an opening in said discharge housing to admit ambient air and a conduit member associated with said opening to direct air flow to said first stage mixing zone and to substantially shield said second stage mixing zone from air flow.

9. The counter-flow drum mixer asphalt plant as in claim 8, said conduit member comprising a teepee shield interposed between said opening in said discharge housing and said dust feeder.

10. The counter-flow drum mixer asphalt plant as in claim 8, said conduit member comprising a cylindrical tube connected to said opening in said discharge housing and extended through said second stage mixing zone to deliver secondary combustion air to said first stage mixing zone.

11. The counter-flow drum mixer asphalt plant as in claim 6, said secondary combustion air supply including a blower to forcibly deliver a regulated flow of secondary combustion air to said first stage mixing zone.

12. The counter-flow drum mixer asphalt plant as in claim 6, said dust feeder comprising a tubular auger having a plurality of discharge openings along the length thereof to deliver fine additives and a pair of flexible shields suspended from said tubular auger along opposite sides of said discharge openings to direct fine additives downwardly to said asphaltic composition within said second stage mixing zone.

13. The counter-flow drum mixer asphalt plant as in claim 6 wherein said drying zone of said cylinder is equipped with a plurality of veiling flights mounted on the interior surface of said cylinder to transport aggregate material through said drying zone to said combustion zone and to create a curtain of falling aggregates in said drying zone with rotation of said cylinder, wherein said hot gas stream flows through the curtain of falling aggregates to heat and dry the aggregate material.

14. The counter-flow drum mixer asphalt plant as in claim 6, wherein said combustion zone of said cylinder is equipped with a plurality of spaced apart, nonveiling flights mounted on the interior surface of said cylinder within said combustion zone to transport aggregate material through said combustion zone and to admit RAP material from said recycle feeder directly into said combustion zone for exposure to radiant heat therein.

15. The counter-flow drum mixer asphalt plant as in claim 14, wherein said recycle feeder includes a collar circumscribing said cylinder and openings through said cylinder in registry with said collar whereby RAP material is introduced to said combustion zone through said spaced apart, nonveiling flights.

16. The counter-flow drum mixer asphalt plant as in claim 6 further comprising a secondary burner mounted adjacent said first end of said cylinder in contact with said hot gas stream discharged from the first end of said cylinder to elevate the temperature of said discharged hot gas stream prior to delivery to air pollution control equipment.

17. The counter-flow drum mixer asphalt plant as in claim 16 further comprising a temperature controller connected to said secondary burner to maintain said discharged hot gas stream prior to delivery to air pollution control equipment above its dew point temperature.

* * * * *